US005417168A

United States Patent [19]

Soper

[11] Patent Number: 5,417,168

[45] Date of Patent: May 23, 1995

[54] FOLDING TABLE

[75] Inventor: Douglas B. Soper, North York, Canada

[73] Assignee: Ino-Products Inc., North York, Canada

[21] Appl. No.: 136,186

[22] Filed: Oct. 15, 1993

[51] Int. Cl.[6] ..... A47B 3/00

[52] U.S. Cl. ..... 108/124; 108/116; 108/6

[58] Field of Search ..... 108/6, 1, 115, 116, 108/119, 124, 129

[56] References Cited

U.S. PATENT DOCUMENTS

| | | | |
|---|---|---|---|
| 2,531,778 | 11/1950 | Merner | 108/116 |
| 2,644,732 | 7/1953 | Westcamp | 108/1 |
| 2,692,175 | 10/1954 | Jacques | 108/124 |
| 3,247,811 | 4/1966 | Bauder | 108/124 X |
| 3,365,072 | 1/1968 | Hill | 108/116 X |
| 3,561,376 | 2/1971 | Knoblock | 108/124 |
| 4,099,469 | 7/1978 | Sahli | 108/1 |
| 4,196,675 | 4/1980 | Cook | 108/124 X |
| 4,296,694 | 10/1981 | Kobayashi | 108/116 |

FOREIGN PATENT DOCUMENTS

| | | | |
|---|---|---|---|
| 801010 | 11/1950 | Germany | 108/124 |
| 120899 | of 1959 | U.S.S.R. | 108/1 |

*Primary Examiner*—Jose V. Chen

*Attorney, Agent, or Firm*—Rogers & Scott

[57] ABSTRACT

A folding table has a table top of synthetic plastic material with an upper working surface and an underside, the underside having at least one rearwardly located leg retainer and at least one forwardly located strut retainer. A leg assembly has an elongated connecting member and a pair of legs extending from opposite ends of the connecting member, each leg having a foot member extending from a lower end thereof remote from the connecting member. An angularly movable strut is pivotally secured at the rear to at least one of the legs and is releasably engageable at the front with the strut retainer. The strut is angularly moveable between a working position in releasable engagement with the strut retainer to maintain the tabletop in a working position and a retracted position between the legs when released from the strut retainer. The or each leg retainer retains the connecting member in engagement therewith while permitting angular movement of the table top between a working position and a folded position in which the table top is substantially parallel to the legs.

6 Claims, 3 Drawing Sheets

FOLDING TABLE

Figure 1:
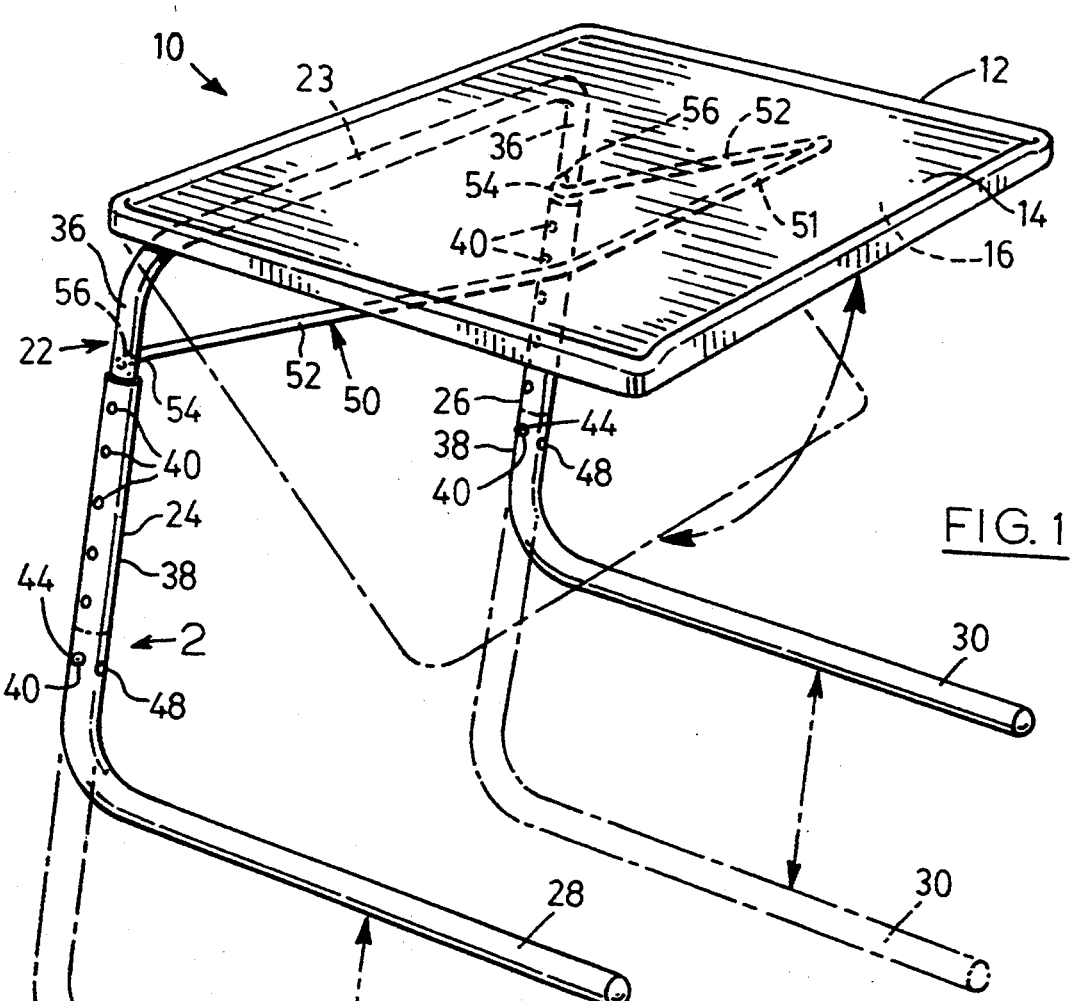

This invention relates to folding tables.

There are of course many known different kinds of folding tables. However, there is still a need for a versatile folding table which is of simple yet attractive construction and which can be easily erected and folded.

According to the invention, a folding table comprises a table top of synthetic plastic material having an upper working surface and an underside, the underside having at least one rearwardly located leg retainer and at least one forwardly located strut retainer, a leg assembly comprising an elongated connecting member and a pair of legs extending from opposite ends of the connecting member, each leg having a foot member extending from a lower end thereof remote from the connecting member and an angularly moveable strut pivotally secured at the rear to at least one of the legs and releasably engageable at the front with the strut retainer. The strut is angularly moveable between a working position in releasable engagement with the strut retainer to maintain the table top in a working position and a retracted position between the legs when released from the strut retainer. The or each leg retainer retains the connecting member in engagement therewith while permitting angular movement of the table top between a working position and a folded position in which the table top is substantially parallel to the legs.

The underside of the table top may have a laterally-spaced pair of rearwardly located leg retainers, and the or each leg retainer may retain the connecting member in releasable snapping engagement therewith. The or each leg retainer may comprise a closely spaced pair of substantially identical leg retainer members which each retain the connecting member in engagement therewith.

The underside of the table top may have a laterally-spaced pair of forwardly located strut retainers, and the or each strut retainer may receive the strut in releasable snapping engagement therewith. The or each strut retainer may receive the strut in releasable engagement therewith at a plurality of positions spaced from one another in a front to rear direction. The or each strut retainer may comprise a closely-spaced pair of substantially identical strut retainer members which each receive the strut in releasable engagement therewith.

The strut may comprise a pair of laterally-spaced side members each pivotally secured at a rear end to a respective leg and a transverse member extending between the front ends of the side members, the transverse member being received by the or each strut retainer in releasable engagement therewith in the working position. The legs may each have upper and lower portions in telescoping engagement, the lower leg portions being securable at different longitudinal positions relative to the upper portions to vary the length of the legs.

The lower leg portions may be angularly movable relative to the upper leg portions about the longitudinal axes of the legs, the lower leg portions being securable in working positions in which the foot members are parallel to one another and folded positions in which the foot members extend in opposite directions side-by-side one another.

Figure 2:
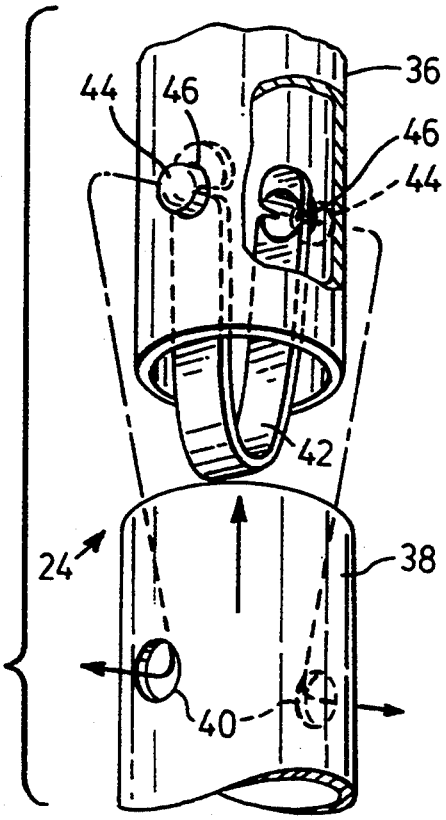
Figure 4:
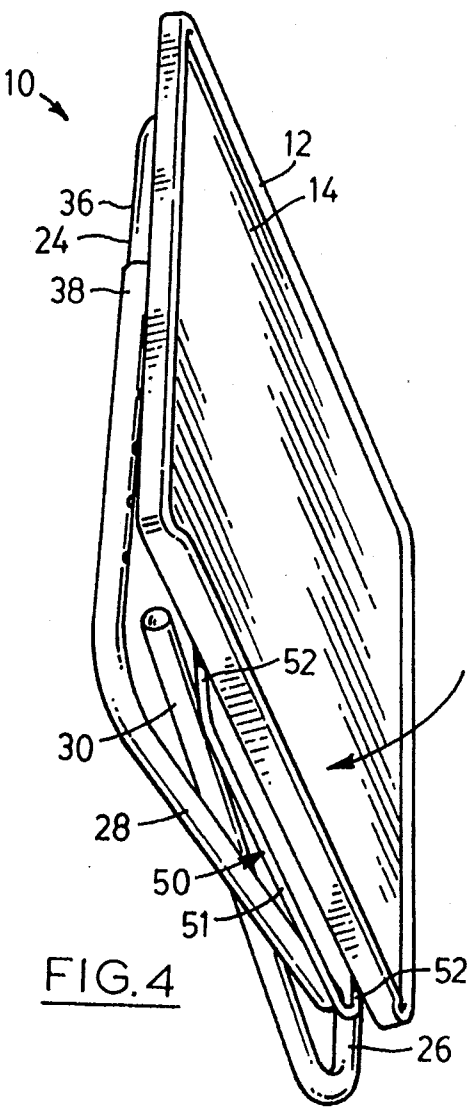
Figure 3:
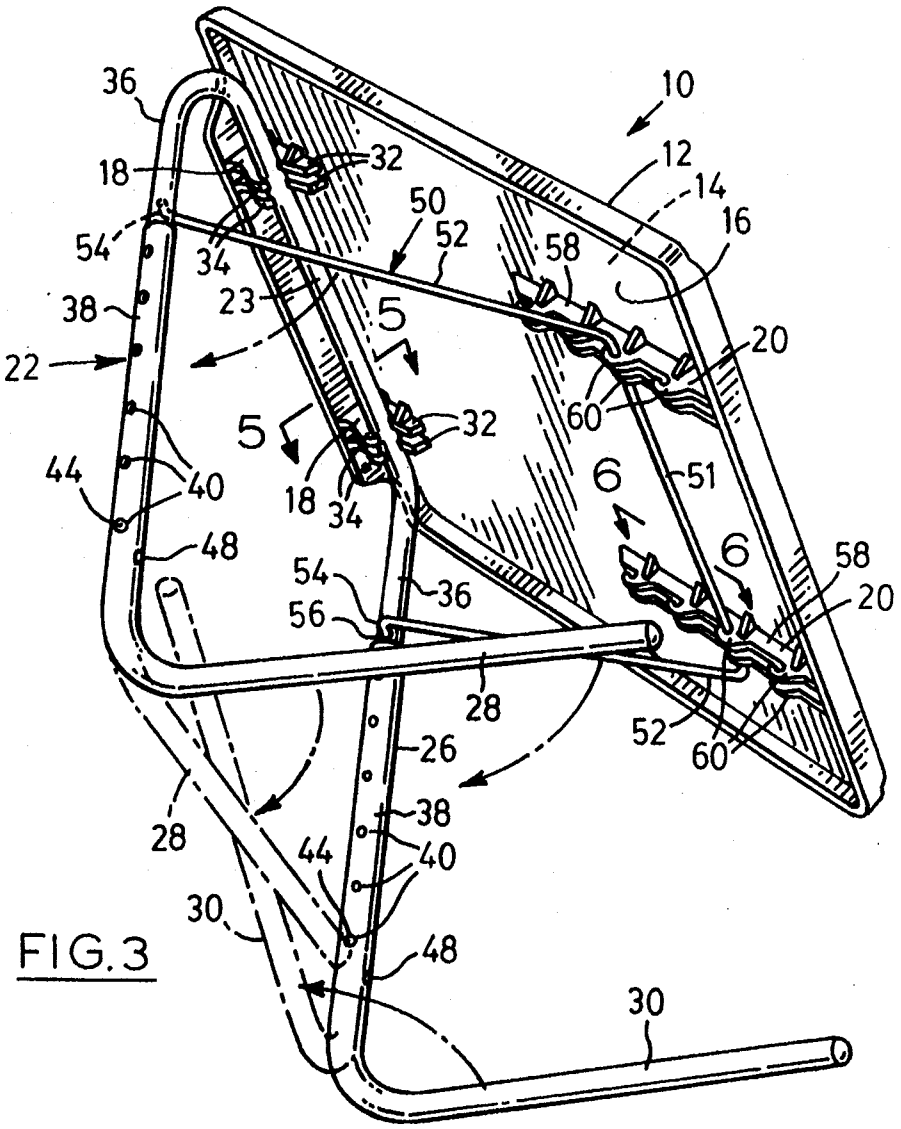
Figure 5:
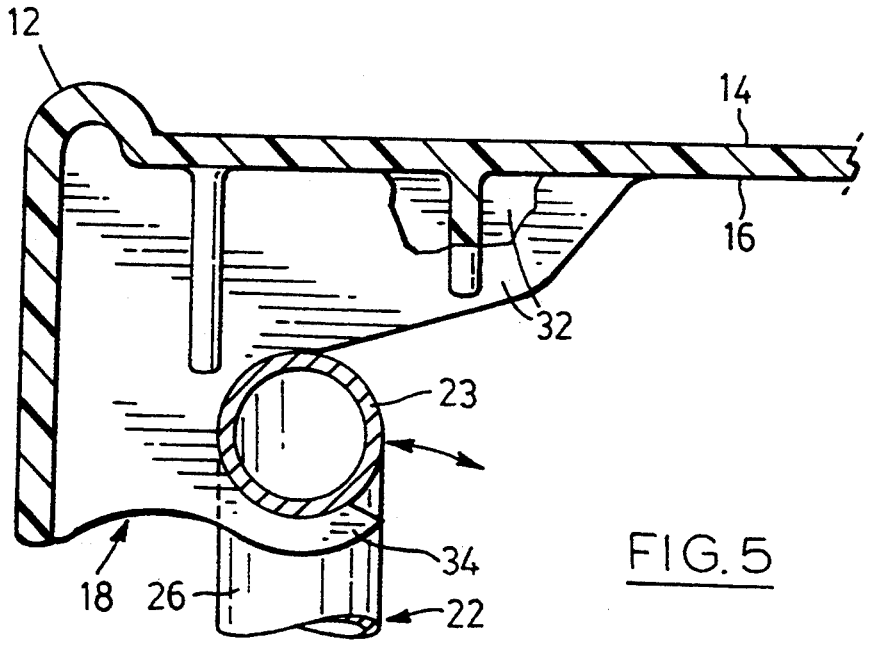
Figure 6:
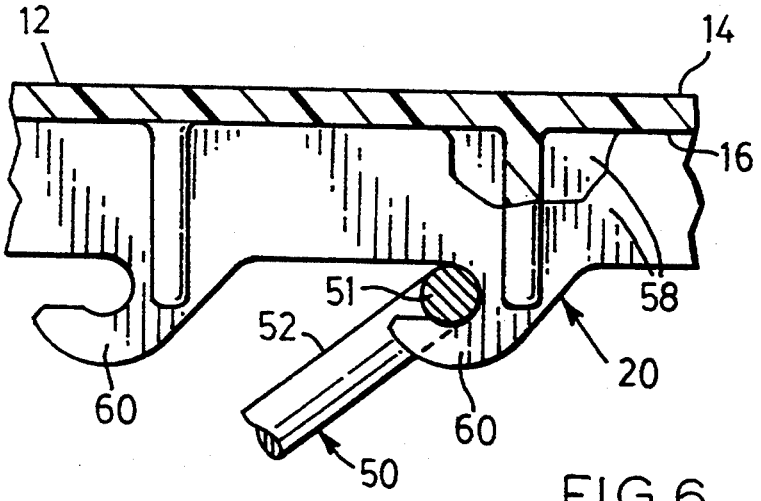

One embodiment of the invention will now be described, by way of example, with reference to the accompanying drawings, of which FIG. 1 is a perspective view of a folding table in accordance with one embodiment of the invention, the table top being in a horizontal working position, FIG. 2 is a detailed view of the portion of a table leg indicated by the arrow 2 in FIG. 1, FIG. 3 is a perspective view of the table with the table top in an inclined working position and showing the underside of the table top, FIG. 4 is a perspective view of the table in the fully folded condition, FIG. 5 is a sectional detail view along the line 5–5 of FIG. 3 of a rear portion of a table top showing a leg retainer and part of the leg assembly, and FIG. 6 is a similar view along the line 6—6 of FIG. 3 of a front portion of the table top showing a strut retainer and part of the strut.

Referring to the drawings, a folding table 10 has an integrally molded plastic table top 12 in the form of a rectangular panel with rounded corners, the table top 12 having an upper working surface 14 and an underside 16. The underside 16 has a laterally-spaced pair of rearwardly located integral leg retainers 18 and a laterally-spaced pair of forwardly located integral strut retainers 20. A leg assembly 22 of tubular steel comprises a transverse connecting member 23 and a pair of legs 24, 26 extending from opposite ends of the connecting member 23, each leg 24, 26 having an elongated foot member 28, 30 respectively extending from the lower end thereof.

Each leg retainer 18 comprises a closely-spaced pair of identical leg retainer members 32 which each have hook portions 34 to retain the connecting member 23 in releasable snapping engagement therewith and permit the table top 12 to be moved angularly relative to the leg assembly 22 in a manner which will be described in more detail later.

Each leg 24, 26 has upper and lower portions 36, 38 in telescopic engagement, the lower leg portions 38 being slidable over the upper leg portions 36. Each upper leg portion 36 is integral with the relevant end of the connecting member 23, and each lower leg portion 38 is integral with the respective foot member 28, 30, the foot members 28, 30 thus also being of tubular steel. Each lower leg portion 38 has a series of vertically-spaced apertures 40 on its laterally outer and inner sides, and each upper leg portion 36 contains a resilient U-shaped catch member 42 adjacent its lower end as shown in FIG. 2. The catch member 42 has a pair of projections 44 which project through apertures 46 in the upper leg portion 38 on opposite sides thereof. The projections 44 are snappingly engageable in selected pairs of apertures 40 in the lower leg portions 38 to enable the length of the legs 24, 26 to be adjusted as indicated in dotted outline in FIG. 1.

For folding purposes, as will be described in more detail later, the lower leg portions 38 can be rotated about their longitudinal axis to the laterally-inwardly extending positions shown in dotted outline in FIG. 3. Each lower leg portion 38 also has an aperture 48 on a front surface so that one of the projections 44 can snap thereinto to retain the lower leg portions 38 in the inwardly folded position.

An angularly movable strut 50 is pivotally secured at the rear to the upper leg portions 36. The strut 50 is a metal rod bent to provide a transverse member 51 at the front and a pair of laterally-spaced side members 52 extending rearwardly from opposite ends thereof. Each side member 52 has a bent free end portion 54 at the rear extending into an aperture 56 in the respective upper leg portion 36 to pivotally secure the strut 50 thereto. Each strut retainer 20 comprises a closely-spaced pair of identical strut retainer members 58 which each have a series of hook portions 60 spaced from one another in the front to rear direction which can each retain the transverse strut member 51 in releasable snapping engagement therewith.

FIG. 1 shows the table in the fully erected position with the table top 12 horizontal. It will be understood that to retain the table top 12 in the horizontal position, the transverse strut member 51 is snapped in to the strut retainer hook portion 60 furthest from the front of the table top 12. The foot members 28, 30 extend forwardly from the legs 24, 26 beneath the table top 12. If it is desired to position the table top 12 in an inclined manner as indicated in dotted outline in FIG. 1 and shown in more detail in FIG. 3, the transverse strut member 51 is snapped into strut hook portions 60 nearer the front of the table top 12.

The table can be completely folded as shown in FIG. 4, by swinging the foot members 28, 30 inwardly as previously described and releasing the transverse strut retainer 51 from the retainer hook portions 60 and permitting the strut 50 to pivot downwardly to a near vertical position. The table top 12 can then be permitted to swing downwardly in the same manner.

The foot members 28, 30 can be left in the forwardly extending position shown in FIGS. 1 and 3, and the strut 50 and table top 12 put in the near vertical position so that the members 28, 30 can be slid under the side or rear of a chair or couch with the table top 12 adjacent the side or rear of the chair or couch. The table is thus then readily accessible for future use, it merely being necessary to slide the table out and position the table top 12 by means of the strut 50.

It will be clear from the above description of a preferred embodiment that the present invention provides a folding table which is of simple yet attractive construction and which can be easily erected and folded.

Other embodiments of the invention will be readily apparent to a person skilled in the art, the scope of the invention being defined in the appended claims.

I claim:

1. A folding table comprising:

a table top of synthetic plastic material having an upper working surface and an underside, said underside having a laterally spaced pair of rearwardly located leg retainers and a laterally spaced pair of forwardly located strut retainers, said leg and strut retainers being formed as part of said table top and being integral therewith, a leg assembly comprising an elongated connecting member and a pair of legs extending from opposite ends of the connecting member, each leg having a foot member extending from a lower end thereof remote from the connecting member, and an angularly movable strut pivotally secured at a rear end thereof to at least one of the legs and releasably engageable at a front end thereof with the strut retainers, each integral leg retainer comprising a closely laterally spaced pair of substantially identical integral leg retainer members each retaining the connecting members in snapping engagement therewith, and each integral strut retainer comprising a closely laterally spaced pair of substantially identical integral strut retainer members each retaining the strut in releasable engagement therewith, said strut being angularly moveable between a working position in releasable engagement with the strut retainers to maintain the tabletop in a working position and a retracted position between the legs when released from the strut retainers, each leg retainer retaining the connecting member in releasable snapping engagement therewith while permitting angular movement of the table top between a working position and a folded position in which the table top is substantially parallel to the legs.

2. A folding table according to claim 1 wherein each strut retainer receives the strut in releasable snapping engagement therewith.

3. A folding table according to claim 1 wherein each strut retainer can receive the strut in releasable engagement therewith at a plurality of positions spaced from one another in a front to rear direction.

4. A folding table according to claim 1 wherein the strut comprises a pair of laterally-spaced side members each pivotally secured at a rear end to a respective leg and a transverse member extending between the front ends of the side members, said transverse member being received by each strut retainer in releasable engagement therewith in the working position.

5. A folding table according to claim 1 wherein said legs each have upper and lower portions in telescoping engagement, the lower leg portions being securable at different longitudinal positions relative to the upper portions to vary the length of the legs.

6. A folding table according to claim 5 wherein the lower leg portions are angularly movable relative to the upper leg portions about the longitudinal axes of the legs, the lower leg portions being securable in working positions in which the foot members are parallel to one another and folded positions in which the foot members extend in opposite directions side-by-side one another.

* * * * *